US011731136B2

(12) United States Patent
Järvenpää et al.

(10) Patent No.: US 11,731,136 B2
(45) Date of Patent: Aug. 22, 2023

(54) LIFTING TOOL FOR NUT OF INNER WEAR PART OF CONE CRUSHER

(71) Applicant: METSO OUTOTEC FINLAND OY, Tampere (FI)

(72) Inventors: Ville Järvenpää, Tampere (FI); Hannu Vakkuri, Tampere (FI)

(73) Assignee: METSO OUTOTEC FINLAND OY, Tampere (FI)

( * ) Notice: Subject to any disclaimer, the term of this patent is extended or adjusted under 35 U.S.C. 154(b) by 441 days.

(21) Appl. No.: 16/975,587

(22) PCT Filed: Feb. 18, 2019

(86) PCT No.: PCT/FI2019/050124

§ 371 (c)(1),
(2) Date: Aug. 25, 2020

(87) PCT Pub. No.: WO2019/162569

PCT Pub. Date: Aug. 29, 2019

(65) Prior Publication Data

US 2020/0391216 A1 Dec. 17, 2020

(30) Foreign Application Priority Data

Feb. 26, 2018 (FI) ..... 20185177

(51) Int. Cl.
*B02C 2/04* (2006.01)
*B02C 2/00* (2006.01)
(Continued)

(52) U.S. Cl.
CPC ..... *B02C 2/04* (2013.01); *B02C 2/005* (2013.01); *B66C 1/422* (2013.01); *B66C 1/62* (2013.01);
(Continued)

(58) Field of Classification Search
CPC .. B02C 2/04; B02C 2/005; B02C 2/00; B02C 23/00; B02C 2210/02; B66C 1/422; B66C 1/62; B66C 1/125; B66C 1/10
See application file for complete search history.

(56) References Cited

U.S. PATENT DOCUMENTS 2,913,189 A 11/1959 Ewald
2,951,725 A 9/1960 St. Jean
(Continued)

FOREIGN PATENT DOCUMENTS

CN 2892791 Y 4/2007
CN 200957357 Y 10/2007
(Continued)

OTHER PUBLICATIONS

Office Action for corresponding Chinese Patent Application No. 201980012920.6 dated Sep. 3, 2021.
(Continued)

*Primary Examiner* — Stephen A Vu
(74) *Attorney, Agent, or Firm* — Andrus Intellectual Property Law, LLP

(57) ABSTRACT

A nut lifting tool of an inner wear part of a cone crusher. The lifting tool has a frame to be placed around a nut to be lifted. The frame has nut lifting lugs for supporting occurring from at least three sides of the center of gravity of the nut and frame suspension brackets for suspending the frame from the nut before lifting the nut. The frame also has an open side for receiving a nut, lateral limiters, which, together with the lifting lugs and the suspension brackets, form a nut receiving space such that the frame can be slid from the open side to surround the nut, and lifting connection pieces for connecting a crane to the frame.

14 Claims, 2 Drawing Sheets

(51) Int. Cl.

| | |
|---|---|
| ***B66C 1/42*** | (2006.01) |
| ***B66C 1/62*** | (2006.01) |
| *B02C 23/00* | (2006.01) |
| *B66C 1/12* | (2006.01) |

(52) U.S. Cl.
CPC ..... *B02C 23/00* (2013.01); *B02C 2210/02* (2013.01); *B66C 1/125* (2013.01)

(56) References Cited

U.S. PATENT DOCUMENTS

| | | | | |
|---|---|---|---|---|
| 3,355,114 | A | 11/1967 | Motz | |
| 4,009,898 | A | 3/1977 | Hampton | |
| 4,826,228 | A * | 5/1989 | Dinitz | B66C 1/12 294/67.1 |
| 5,303,968 | A * | 4/1994 | Trine | B66C 1/625 294/90 |
| 5,323,976 | A | 6/1994 | Johnson et al. | |
| 5,476,300 | A * | 12/1995 | Dodge | B66C 1/54 294/93 |
| 6,036,247 | A * | 3/2000 | Gertz | B66C 1/625 294/90 |
| 6,609,742 | B1 | 8/2003 | Macom et al. | |
| 8,393,659 | B2 * | 3/2013 | Stroh | B66C 1/30 294/81.5 |
| 9,546,079 | B1 | 1/2017 | Mercier | |
| 10,549,956 | B2 | 2/2020 | Kuvaja et al. | |
| 2013/0043697 | A1 | 2/2013 | Holmes | |

FOREIGN PATENT DOCUMENTS

| | | | |
|---|---|---|---|
| CN | 1027595534 | A | 11/2012 |
| CN | 202657828 | U | 1/2013 |
| CN | 202785238 | U | 3/2013 |
| CN | 203740874 | U | 7/2014 |
| CN | 104755170 | A | 7/2015 |
| CN | 104340847 | B | 1/2017 |
| WO | 2011029133 | A1 | 3/2011 |
| WO | 2013149820 | | 10/2013 |
| WO | 2014064329 | A1 | 5/2014 |

OTHER PUBLICATIONS

Search Report for priority Finnish Application No. 20185177 dated Sep. 19, 2018.
International Search Report and Written Opinion for International Application No. PCT/FI2019/050124 dated Aug. 1, 2019.
Search Report for corresponding Chinese Patent Application No. 201980012920.6 dated Apr. 20, 2021.

* cited by examiner

LIFTING TOOL FOR NUT OF INNER WEAR PART OF CONE CRUSHER

CROSS-REFERENCE TO RELATED APPLICATIONS

This application is the U.S. national stage application of International Application PCT/FI2019/050124, filed Feb. 18, 2019, which international application was published on Aug. 29, 2019, as International Publication WO 2019/162569 A1 in the English language. The International Application claims priority of Finnish Patent Application No. 20185177 filed Feb. 26, 2018.

TECHNICAL FIELD

The present invention relates to a lifting tool for a nut of an inner wear part of a cone crusher.

BACKGROUND ART

This section illustrates useful background information without admission of any technique described herein representative of the state of the art.

A cone crusher crushes mineral material on a conical inner wear part. The inner wear part is supported from below by a support cone and fixed to the support cone with a nut of 0.5 m to 1.5 m diameter. The nut can weigh over 100 kg. Since the nut is also located over the conical structure, a failed lifting attempt may result in the nut falling on a worker or in material damage.

Lifting lugs can be formed in the nut, but crushable stone material is fed onto the nut, which material would easily break or block such lugs. The lugs would also impede the flow of the crushed stone material from top of the nut to an actual crushing zone between the inner wear part and the outer wear part.

SUMMARY

According to a first example aspect of the invention there is provided a lifting tool for a nut of an inner wear part of a cone crusher. The lifting tool is characterized in that the lifting tool comprises:

a frame to be placed around the nut to be lifted, the frame comprising:

nut lifting lugs for supporting occurring from at least three sides of the center of gravity of the nut;

frame suspension brackets for suspending the frame from the nut before lifting the nut; an open side for receiving the nut;

lateral limiters which, together with the lifting lugs and the suspension brackets, form a nut receiving space such that the frame can be slid from the open side to surround the nut; and lifting connection pieces for connecting a crane to the frame.

The frame may comprise means for closing the open side for duration of lifting, such as a latch, a bolt, a threaded rod, or a chain.

The latch may be hinged for pivoting in front of the open side. The latch may comprise a locking for keeping the latch in its closed position during lifting. The locking may comprise a locking screw. The locking may comprise a locking nut. The locking may comprise, in conjunction with a lifting connection piece, a member attached to a lifting member of the crane.

The frame may be formed of one piece. The frame may be formed of a steel plate. The frame may be formed of a plate. The plate may be provided with protrusions for the suspension brackets, which protrusions are bent to protrude onto the nut to be attached to the frame and further bent over the nut to extend over a part of the radius of the nut towards the axis of rotation of the nut by which the nut is connected to the cone crusher. The protruding portion of the protrusion may form a lateral limiter. The upper portion of the protrusion may be bent to form a suspension bracket. The suspension bracket may comprise a clamping member for grabbing to the nut. The clamping member may comprise a hole formed in the suspension bracket for a screw to be screwed. The hole may be threaded.

The latch may be formed from a single plate part. The latch may be formed of a steel plate. The latch may comprise a lateral limiter formed by bending a protrusion of the plate part. The latch may comprise a suspension bracket formed by bending a protrusion of the plate part.

The frame may comprise downwardly bent stiffeners. The stiffeners may be arranged to keep the frame separate from its base to reduce corrosion exposure during storage.

The lifting connection pieces may be lifting lugs. The lifting lugs may be formed into a plate-formed frame by bending. The lifting lugs may be more outwards than the lateral limiters from the thread of the nut to provide sufficient space for connecting the lifting member of the crane.

The nut support brackets may consist of one piece. A body of the frame may be arranged to settle against the lower edge of the nut.

Embodiments of the present invention have been illustrated in the foregoing in connection with some aspect or aspects of the invention. A person skilled in the art understands that any embodiment of some aspect may be applied in the same aspect and other aspects alone or in combination with other embodiments.

BRIEF DESCRIPTION OF THE DRAWINGS

The invention will be described with reference to the accompanying drawings.

DETAILED DESCRIPTION

In the following description, like reference signs denote like elements or steps.

Figure 1:
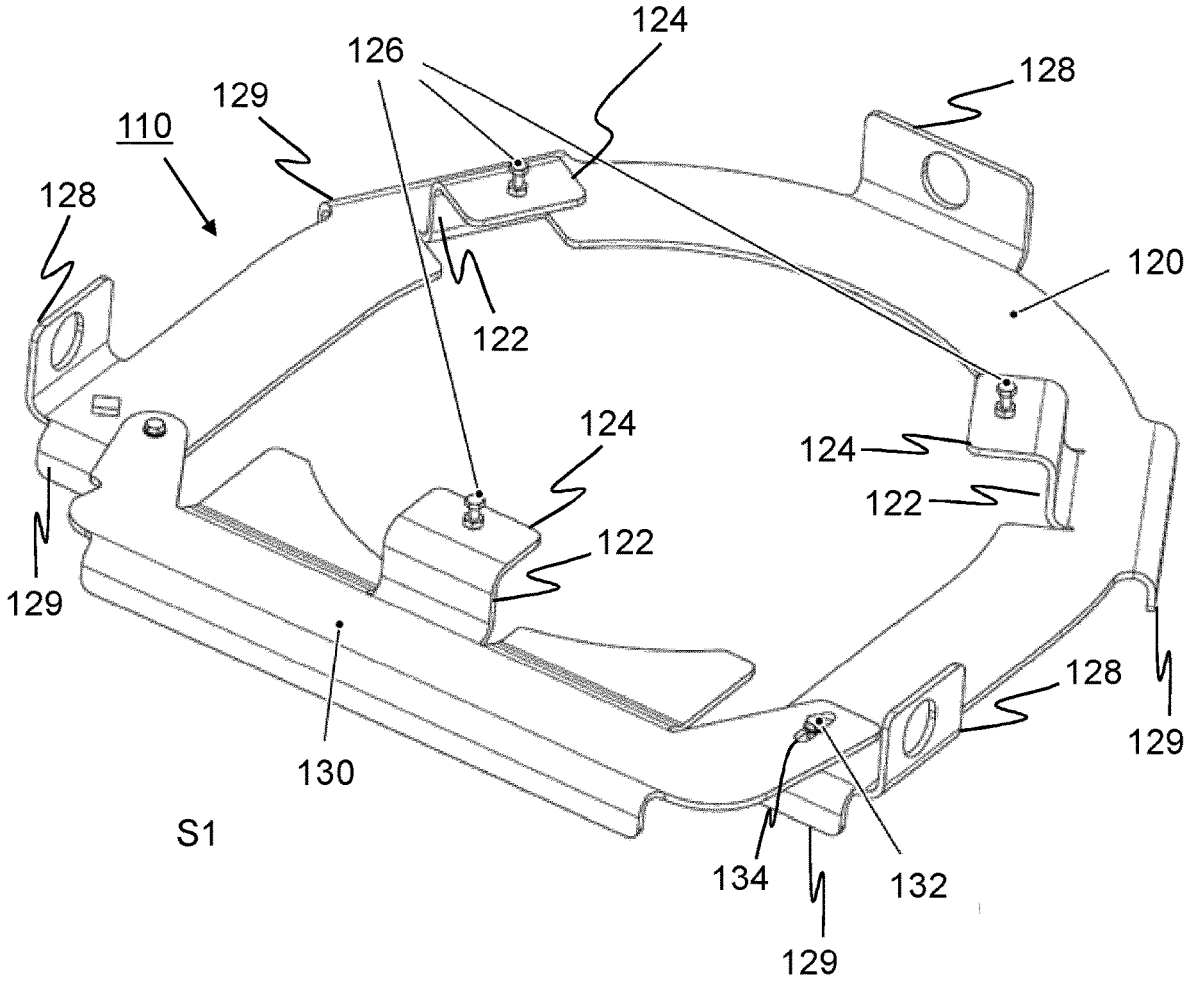
FIG. 1 shows a nut lifting tool for an inner wear part of a cone crusher according to the first embodiment of the invention.

FIG. 1 shows a nut lifting tool 100 of an inner wear part of a cone crusher according to a first embodiment of the invention. The lifting tool 100 comprises a frame 110 to be placed around a nut to be lifted. The frame 110 comprises:

- nut lifting lugs (body 120 or optionally protrusions formed onto a surface of a body 120, e.g. using screw heads or bent edge edges) for supporting occurring from at least three sides of the center of gravity of the nut;
- frame suspension brackets 124 for suspending the frame from the nut before lifting the nut;
- an open side S1 for receiving a nut;
- lateral limiters 122, which, together with the lifting lugs and the suspension brackets, form a nut receiving space such that the frame can be slid from the open side to surround the nut; and lifting connection pieces 128 for connecting a crane to the frame 110.

The frame 110 may comprise means for closing the open side S1 for duration of lifting, such as a latch 130, bolt, threaded rod, or chain. FIG. 1 shows the latch 130 hinged to be pivoted to go in front the open side S1 of the frame for receiving the nut into the frame or for releasing from the frame. The latch 130 of FIG. 1 comprises a locking for keeping the latch in its closed position during lifting, which locking in this case is formed by a locking screw 132 and a groove 134 made in the latch. Alternatively or additionally, the locking may comprise a locking nut or, together with the lifting connection piece, a member connecting to the lifting member of the crane, such as an ear formed on the end of the latch, which pivots next to a corresponding ear formed on the body. For example, in FIG. 1 the bolt 130 could be longer, and its end bent to settle next to the lifting lug 128 on a hingeless side of the open side of the frame 110. This bent end could have an opening for putting a lifting hook of the crane through both the lifting lug 128 and the thus modified latch.

The frame 110 of FIG. 1 is formed of a single piece (excluding the latch), e.g., of a plate of steel or a plate of composite. Protrusions (122, 124) are formed in the frame 120 or the plate 1 of FIG. 1 for the suspension brackets, the protrusions being bent to protrude onto the nut 110 to be connected to the frame 110 and further bent over the nut to extend a part of the radius of the nut towards the nut rotation axis with which the nut is connected to the cone crusher. In this case, the protruding portion of the protrusion forms a lateral limiter 122. The upper portion of the protrusion is bent to form a suspension bracket 124. The suspension bracket 124 may comprise a clamping member for grabbing to the nut, such as a hole in the suspension bracket 124 for the bolt 126, which hole may be threaded.

The latch 130 of FIG. 1 is formed of a single plate part, such as a steel plate. The latch 130 of FIG. 1 comprises a lateral limiter 122 formed by bending the plate part, and a suspension bracket 124, which may be similar to those of the frame 110. Optionally, the lateral limiter 122 may raise the suspension bracket by a plate thickness less than the lateral limiters 124 formed in the body 120 of the frame 110.

Additionally, the frame 110 of FIG. 1 further comprises downwardly bent stiffeners 129 for keeping the frame 110 separate from its base for reducing exposure to corrosion during storage.

The lifting connection pieces 128 of FIG. 1 are lifting lugs that are formed by bending the plate formed frame 120. The lifting lugs 128 may be more outwards than the lateral limiters from the thread of the nut for leaving sufficient space for connecting the lifting member of the crane.

Figure 2:
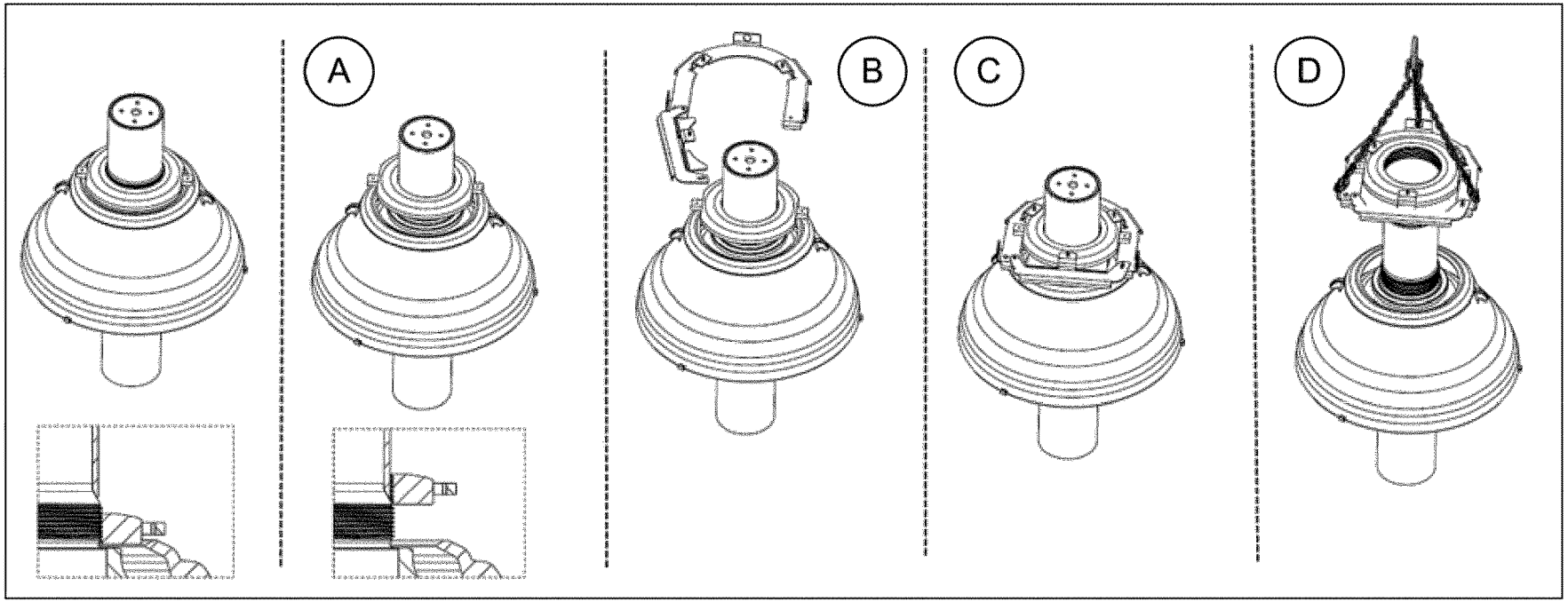
FIG. 2 shows a use example for illustrating the structure of the lifting tool of FIG. 1

FIG. 2 shows a use example of the lifting tool for illustrating the construction of the lifting tool of FIG. 1, wherein:

1. the nut of the inner wear member is opened until the nut is completely turned open, i.e. the thread is no longer in contact, point A;

2. During the opening of the nut, any dirt is removed that may hamper the use of the lifting tool 100 on the nut surfaces;

3. Release the lifting tool latch lock and open the latch to its extreme position, point B;

4. Lift the lifting tool and slide it around the nut, and close the latch with the nut and tighten the locking bolt on the latch, point C;

5. Tighten locking or clamping screws of the nut against the top surface of the nut;

6. Remove clearance from lifting chains with the crane and lift the nut;

7. Lower the nut onto a base and release the lifting tool from the nut by loosening the clamping screws and opening the latch.

The foregoing description provides non-limiting examples of some embodiments of the invention. It is clear to a person skilled in the art that the invention is yet not restricted to details of the embodiments presented, but the invention can be implemented in other equivalent ways.

Some of the features of the afore-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A nut lifting tool of an inner wear part of a cone crusher, comprising:

a frame to be placed around a nut to be lifted, which frame comprises:

nut lifting lugs for supporting occurring from at least three sides of the center of gravity of the nut;

frame suspension brackets for suspending the frame from the nut before lifting the nut;

an open side for receiving a nut;

a hinged latch for closing the open side for the duration of lifting;

lateral limiters, which, together with the lifting lugs and the suspension brackets, form a nut receiving space such that the frame can be slid from the open side to surround the nut; and lifting connection pieces for connecting a crane to the frame.

2. The nut lifting tool of claim 1, wherein the latch comprises a locking for keeping the latch in its closed position during the lifting.

3. The nut lifting tool of claim 1, wherein the nut lifting lugs, the suspension brackets, the lateral limiters and the lifting connection pieces are formed of one piece.

4. The nut lifting tool of claim 1, wherein the frame is formed of one piece.

5. The nut lifting tool of claim 1, wherein the frame is formed of a plate.

6. The nut lifting tool of claim 5, wherein:

protrusions are formed for the suspension brackets in the plate that forms the frame;

the protrusions are bent to protrude onto the nut to be connected to the frame; and the protrusions further bent over the nut to extend a part of a radius of the nut towards a nut rotation axis with which the nut is connected to the cone crusher.

7. The nut lifting tool of claim 1, wherein the latch is formed of one plate part.

8. The nut lifting tool of claim 7, wherein the latch comprises a lateral limiter formed by bending the plate part.

9. The nut lifting tool of claim 8, wherein the lifting lugs are more outwards than the lateral limiters from a thread of the nut.

10. The nut lifting tool of claim 8, wherein the latch comprises a suspension bracket formed by bending a protrusion of the plate part.

11. The nut lifting tool of claim 1, wherein the frame comprises downwardly bent stiffeners.

12. A nut lifting tool of an inner wear part of a cone crusher, comprising:

a frame to be placed around a nut to be lifted, which frame comprises:

a clamping member for grabbing to the nut;

nut lifting lugs for supporting occurring from at least three sides of the center of gravity of the nut;

frame suspension brackets for suspending the frame from the nut before lifting the nut;

an open side for receiving a nut;

lateral limiters, which, together with the lifting lugs and the suspension brackets, form a nut receiving space such that the frame can be slid from the open side to surround the nut; and lifting connection pieces for connecting a crane to the frame.

13. The nut lifting tool of claim 12, wherein the clamping member is arranged to grab to the nut by clamping by turning at least one threaded member.

14. The nut lifting tool of claim 12 further comprising a hinged latch for closing the open side of the frame for the duration of lifting.

* * * * *